US011581120B2

(12) United States Patent
Ochiai et al.

(10) Patent No.: US 11,581,120 B2
(45) Date of Patent: Feb. 14, 2023

(54) CORE COMPONENT, METHOD OF MANUFACTURING SAME, AND INDUCTOR

(71) Applicant: KYOCERA Corporation, Kyoto (JP)

(72) Inventors: Hitomi Ochiai, Omihachiman (JP); Masamichi Shingu, Shiga (JP); Yuki Kitagawa, Higashiomi (JP); Hideki Mori, Shiga (JP); Mitsuya Takayama, Koka (JP)

(73) Assignee: KYOCERA Corporation, Kyoto (JP)

( * ) Notice: Subject to any disclaimer, the term of this patent is extended or adjusted under 35 U.S.C. 154(b) by 740 days.

(21) Appl. No.: 16/524,879

(22) Filed: Jul. 29, 2019

(65) Prior Publication Data

US 2020/0227198 A1 Jul. 16, 2020

(30) Foreign Application Priority Data

Jan. 11, 2019 (JP) ..... JP2019-003546

(51) Int. Cl.

| | |
|---|---|
| ***H01F 27/28*** | (2006.01) |
| ***H01F 27/255*** | (2006.01) |
| ***H01F 41/02*** | (2006.01) |
| ***H01F 41/06*** | (2016.01) |

(52) U.S. Cl.

CPC ..... *H01F 27/255* (2013.01); *H01F 27/2823* (2013.01); *H01F 41/0246* (2013.01); *H01F 41/06* (2013.01)

(58) Field of Classification Search

USPC ..... 336/221, 212, 83

See application file for complete search history.

(56) References Cited

U.S. PATENT DOCUMENTS

| | | | | |
|---|---|---|---|---|
| 2016/0118183 | A1* | 4/2016 | Wada | H01F 27/292 336/192 |
| 2017/0309386 | A1* | 10/2017 | Noya | H01F 17/045 |
| 2017/0330672 | A1 | 11/2017 | Uchida et al. | |
| 2017/0330676 | A1* | 11/2017 | Uchida | H01F 27/292 |

FOREIGN PATENT DOCUMENTS

| | | | |
|---|---|---|---|
| JP | H05-275256 | A | 10/1993 |
| JP | 2003-257725 | A | 9/2003 |
| JP | 2011-223025 | A | 11/2011 |
| JP | 2011223025 | A * | 11/2011 |
| JP | 2017-204596 | A | 11/2017 |

* cited by examiner

*Primary Examiner* — Shawki S Ismail
*Assistant Examiner* — Kazi S Hossain
(74) *Attorney, Agent, or Firm* — Procopio Cory Hargreaves and Savitch LLP

(57) ABSTRACT

A core component is made of a sintered body of an inorganic powder, in which the core component includes a columnar winding portion and a flange portion integrally formed with the columnar winding portion at both axial ends of the columnar winding portion, in which when observed in a cross section perpendicular to an axial direction, a surface layer portion of the columnar winding portion and a surface layer portion of the flange portion have a void occupancy area smaller than a void occupancy area of an inside of the columnar winding portion and of an inside of the flange portion, respectively.

8 Claims, 4 Drawing Sheets

CORE COMPONENT, METHOD OF MANUFACTURING SAME, AND INDUCTOR

BACKGROUND OF THE INVENTION

1. Field of the Invention

The present disclosure relates to a core component made of a sintered body of an inorganic powder, a method of manufacturing the core component, and an inductor.

2. Description of Related Art

Conventionally, when winding a conductive wire, for example, a conductive wire covered with an insulating material such as polyurethane or polyester, around a winding portion of a core component such as a ferrite core, the conductive wire is mounted in a state of being aligned with the winding portion by fixing the end of the conductive wire to any one of the flange portion provided at both ends of the winding portion, and feeding the conductive wire from one end to the other end of the winding portion while bringing adjacent conductive wires into contact with each other.

Recently, as shown in Japanese Patent Application Laid-Open No. 2017-204596, the miniaturization of electronic devices such as portable terminals is progressing, and the demand for miniaturization of core components mounted on such electronic devices is also increasing. Further, the same publication discloses that the conductive wire which is wound around the winding portion is also thinned, and the diameter thereof is about 20 μm.

In order to obtain a core component having high strength, Patent Application Laid-Open No. 2003-257725 discloses that a magnetic powder is pressure-molded with an upper punch and a lower punch to manufacture the core component including a winding portion and flange portion provided at both ends thereof (FIGS. 1A, B).

SUMMARY OF THE INVENTION

The core component of the present disclosure includes a columnar winding portion having a first axial end and a second axial end and a flange portion integrally formed with the columnar winding portion at both axial ends of the columnar winding portion, in which when observed in a cross section perpendicular to an axial direction, a surface layer portion of the columnar winding portion has a void occupancy area smaller than a void occupancy area of an inside of the columnar winding portion.

The method of manufacturing the core component according to the present disclosure includes filling and pressure molding an inorganic powder between an upper punch and a lower punch to form a pressure-molded compact, wherein each of the upper punch and lower punch has an arc-shaped pressing surface for molding the columnar winding portion and the flange portion; and sintering the pressure-molded compact to form a sintered body, in which the arc-shaped pressing surface of the upper punch and the arc-shaped pressing surface of the lower punch have different radiuses of curvature at least at a portion forming the columnar winding portion, and wherein a molding pressure at a time of the pressure molding is 98 Mpa or more.

The inductor of the present disclosure includes the core component and a conductive wire wound around the columnar winding portion of the core component.

DETAILED DESCRIPTION OF PREFERRED EMBODIMENTS

Figure 1A:
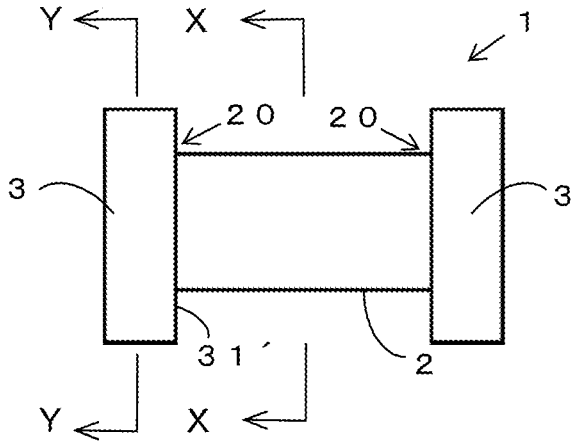
FIG. 1A is a side view of a core component according to an embodiment of the present disclosure.

Hereinafter, core components according to an embodiment of the present disclosure will be described. As shown in FIG. 1A, a core component 1 includes a columnar winding portion 2 and a flange portion 3 integrally formed with the columnar winding portion 2 at both axial ends of the columnar winding portion 2. The core component 1 is made of a sintered body of an inorganic powder such as alumina in addition to ferrite. A conductive wire (not shown) is wound around the columnar winding portion 2. Both ends of the conductive wire are connected to the lead-out electrodes formed on the flange portion 3. For example, the length of the columnar winding portion 2 in the axial direction is 1 mm to 2 mm, and the diameter is 0.5 mm to 2 mm. Further, the length (width) of each flange portion 3 in the axial direction is 0.2 mm to 0.8 mm, and the diameter is 1.5 mm to 4 mm.

Figure 1B:
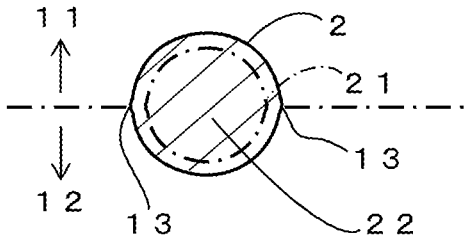
FIG. 1B is a sectional view thereof taken along line X-X.

In the core component 1 of the present embodiment, as shown in FIG. 1B, when the columnar winding portion 2 is observed in a cross section perpendicular to the axial direction, a surface layer portion 21 of the columnar winding portion 2 has a void occupancy area smaller than that of an inside 22 of the columnar winding portion 2. For example, the void occupancy area in the surface layer portion 21 of the columnar winding portion 2 is 0.5% to 3%.

Therefore, since the surface layer portion 21 of the columnar winding portion 2 is dense, the strength of the columnar winding portion 2 is improved, the resistance to deformation is improved, and the particle shedding (dropping of the inorganic powder from the surface) is also suppressed. In addition, the void occupancy area in the surface layer portion is reduced, so that the dielectric loss tangent (tan δ) is reduced and the frequency characteristics are also improved.

Here, the surface layer portion 21 refers to a region having a depth of 0.22 mm or less from the surface of the columnar winding portion 2 toward the axial center. The inside 22 refers to a region excluding the surface layer portion 21. Further, in order to obtain the void occupancy area, for example, the portion where the size and distribution of the voids are observed on average is selected among the mirror surface of each of the surface layer portion 21 and the inside 22 obtained by polishing them using diamond abrasive grains having an average particle diameter of 1 μm (this mirror surface is the cross section perpendicular to the axial direction of the columnar winding portion 2). Next, for example, the range in which the area is $3.84\times10^{-2}$ $mm^2$ (lateral length is 0.226 mm, longitudinal length is 0.170 mm) is photographed with a scanning electron microscope at a magnification of 500 to obtain the observation image. Then, for this observation image, the void occupancy area can be determined by a method called the particle analysis using the image analysis software "A-Zou Kun (ver 2.52)" (registered trademark, manufactured by Asahi Kasei Engineering Corporation, in the following description, the description of the image analysis software "A-Zou Kun" refers to the image analysis software manufactured by Asahi Kasei Engineering Corporation).

Figure 1C:
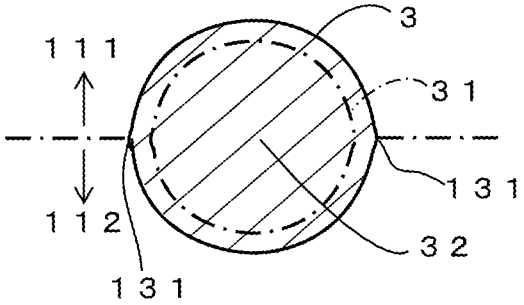
FIG. 1C is a sectional view thereof taken along line Y-Y.

The void occupancy area of the flange portion 3 may have the same relationship as that of the columnar winding portion 2. That is, as shown in FIG. 1C, when the flange portion 3 is observed in a cross section perpendicular to the axial direction, a surface layer portion 31 of the flange portion 3 has a void occupancy area smaller than a void occupancy area of an inside 32 of the flange portion 3. For example, the void occupancy area in the surface layer portion 31 of the flange portion 3 is 0.5% to 4%.

In addition, it is preferable that a gap C between adjacent voids represented by the following Formula at least in the surface layer portion 21 of the columnar winding portion 2 be 6 to 12 μm.

Formula: $C=L-R$ where, L is the average value of the distance between the centers of gravity between adjacent voids in the surface layer portion 21 or the inside 22, and R is the average value of the equivalent circle diameters of the voids in the surface layer portion 21 or the inside 22.

At this time, it is more preferable that the voids present in the surface layer portion 21 have a larger gap C between adjacent voids than the voids present in the inside 22. Specifically, it is preferable that the difference between the gap $C_{S1}$ between the voids in the surface layer portion 21 and the gap $C_{S2}$ between the voids in the inside 22 obtained from the above formula be 1 μm or more.

As described above, since the void distribution at least in the surface layer portion 21 of the columnar winding portion 2 is sparse, so that the particle shedding generated from the inside and the outline of the voids is reduced, and when the conductive wire is wound around the columnar winding portion 2, it is not likely to cause damage to the conductive wire such as disconnection.

As in the columnar winding portion 2, the voids present in the surface layer portion 31 of the flange portion 3 may have a larger gap C between adjacent voids shown by the above formula than the voids present in the inside 32. Specifically, the difference between the gap $C_{F1}$ between the voids in the surface layer portion 31 and the gap $C_{F2}$ between the voids in the inside 32 is 1 μm or more. Here, the surface layer portion 31 refers to a region having a depth of 0.22 mm or less from the surface of the flange portion 3 toward the axial center. The inside 32 refers to a region excluding the surface layer portion 31.

The average value of the distance between the centers of gravity between the voids and the average value of the equivalent circle diameters of the voids can be determined by the following method.

First, the portion where the size and distribution of the voids are observed on average is selected among the mirror surface of each of the surface layer portion and the inside obtained by polishing them using diamond abrasive grains (this mirror surface is the cross section perpendicular to the axial direction of the columnar winding portion 2). For example, the range in which the area is $3.84\times10^{-2}$ mm$^2$ (lateral length is 0.226 mm, longitudinal length is 0.170 mm) is photographed with a scanning electron microscope at a magnification of 500 to obtain an observation image. Then, using the above-mentioned image analysis software "A-Zou Kun", the average value of the distances between the centers of gravity of the voids can be determined by the distance-between-centroid method of dispersion measurement.

In addition, the average value of the equivalent circle diameters of the voids can be determined by performing analysis using the same observation image as the above-described observation image by means of the particle analysis using the image analysis software "A-Zou Kun".

As the setting conditions of the distance-between-centroid method and the particle analysis, for example, a threshold value which is an index indicating light and dark of an image may be 83, lightness may be dark, a small figure removing area may be 0.2 μm$^2$ and a noise removing filter may be present. In the above measurement, the threshold value is 83, but the threshold value may be adjusted according to the brightness of the observation image. The lightness is dark, the method of binarization is manual, and the small figure removing area is 0.2 μm$^2$ and a noise removing filter is present. The threshold value may be manually adjusted so that a marker whose size changes according to the threshold value in the observation image matches the shape of the voids.

The columnar winding portion 2 has a cutting level difference (Rδc) of the surface roughness curve of 0.2 μm or more and 2 μm or less. The cutting level difference (Rδc) represents the difference between the cutting level at a 25% loading length rate in the surface roughness curve and the cutting level at a 75% loading length rate in the roughness curve. The cutting level difference (Rδc) is a parameter that represents both the axial direction and the radial direction.

Similarly, the cutting level difference Rδc of the roughness curve on the surface of the flange portion 3 is preferably 0.2 μm or more and 2 μm or less.

When the cutting level difference (Rδc) is 0.2 μm or more, an appropriate anchor effect can be given to the conductive wire. Therefore, the slip of the conductive wire is appropriately suppressed, the winding installation becomes easy, and the winding of the conductive wire to the columnar winding portion 2 can be performed with high accuracy, so that the occurrence of winding deviation or the like can be prevented. On the other hand, the cutting level difference (Rδc) is 2 μm or less, so that it is possible to suppress the variation in the intervals between the wound conductive wires and the height difference between the adjacent conductive wires.

Moreover, it is preferable that the root mean square height (Rq) in a roughness curve be 0.07 μm or more and 2.5 μm or less. When the root mean square height (Rq) is 0.07 μm or more, an appropriate anchor effect can be given to the conductive wire, which facilitates the mounting. On the other hand, when the conductive wire is wound with a root mean square height (Rq) of 2.5 μm or less, the risk of disconnection can be reduced.

The columnar winding portion 2 is pressure-molded at a high pressure by a lower punch 5 and an upper punch 6 as described later, so that the surface layer portion 21 of the columnar winding portion 2 is denser than a surface layer portion 31' of an inner portion of the flange portion 3 shown in FIG. 1A. Therefore, when the conductive wire is wound, it is possible to reduce the risk of particle shedding caused by the winding.

The cutting level difference Rδc and the root mean square height (Rq) of the roughness curve are in accordance with JIS B 0601: 2001, and can be measured by a ultra-depth color 3D shape measuring microscopes (for example, VK-9500 manufactured by Keyence Corporation). The measurement conditions are as follows; measurement mode: color ultra depth, gain: 953, measurement resolution in the height direction (pitch): 0.05 μm, magnification: 400 times, cutoff value $\lambda_s$: 2.5 μm, cutoff value $\lambda_c$: 0.08 mm.

Here, it is sufficient that the measurement range per one location is 580 μm to 700 μm×280 μm to 380 μm when the columnar winding portion 2 is to be measured, and 70 μm to 170 μm×500 μm to 550 μm when the flange portion 3 is to be measured.

As shown in FIG. 1A, the radius of curvature of a corner portion 20 where the columnar winding portion 2 and the flange portion 3 intersect is preferably equal to or smaller than the diameter of the conductive wire. Specifically, the radius of curvature of the corner portion 20 is 40 μm or less, preferably 10 to 30 μm. This can prevent offset of the conductive wire.

Next, a method of manufacturing the core component 1 by press molding will be described based on FIGS. 2 and 3. FIGS. 2A and 2B are a cross-sectional view and a longitudinal-sectional view, respectively, showing the molding state of the core component 1. The press molding apparatus used includes a die 4, the lower punch 5 and the upper punch 6. The lower punch 5 includes a first lower punch 51 and a second lower punch 52. The upper punch 6 includes a first upper punch 61 and a second upper punch 62.

Figure 2A:
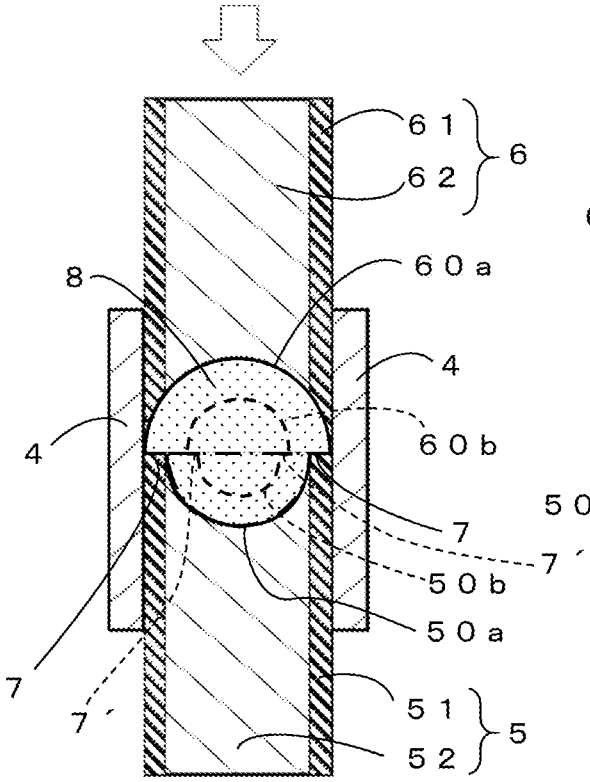
FIG. 2A and FIG. 2B are a cross-sectional view and a longitudinal-sectional view, respectively, showing how a core component according to an embodiment of the present disclosure is molded with a molding die.
Figure 2B:
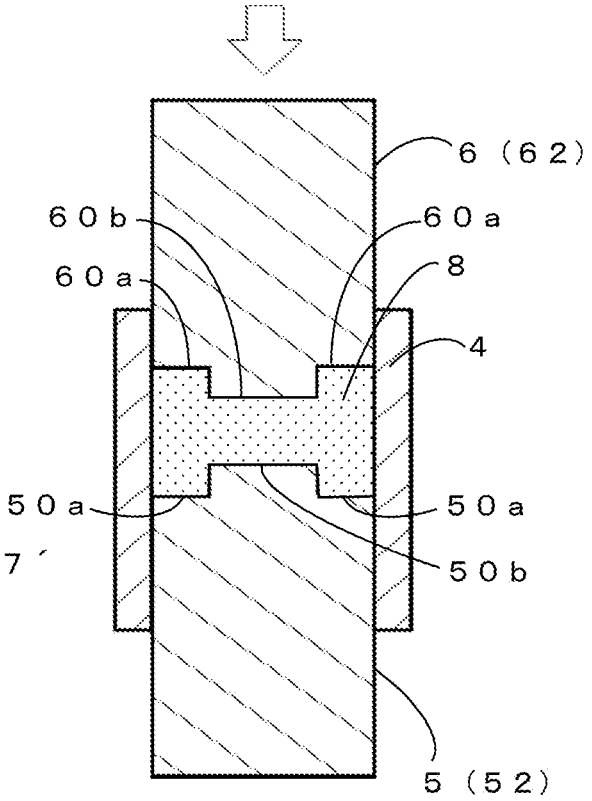

As shown in FIG. 2A, the lower punch 5 and the upper punch 6 have arc-shaped pressing surfaces 50*a*, 50*b*, 60*a*, and 60*b* for forming the columnar winding portion 2 and the flange portion 3, respectively. The radius of curvature of the pressing surfaces 50*a* and 50*b* of the lower punch 5 and the radius of curvature of the pressing surfaces 60*a* and 60*b* of the upper punch 6 are different from each other at portions where the columnar winding portion 2 and the flange portion 3 are formed. In the present embodiment, the radius of curvature of the pressing surfaces 60*a* and 60*b* of the upper punch 6 is larger than the radius of curvature of the pressing surfaces 50*a* and 50*b* of the lower punch 5. Conversely, the radius of curvature of the pressing surfaces 50*a* and 50*b* of the lower punch 5 may be larger than the radius of curvature of the pressing surfaces 60*a* and 60*b* of the upper punch 6.

Therefore, a stepped portion 7 is formed on both sides in a state where the pressing surfaces 50*a* and 50*b* of the lower punch 5 and the pressing surfaces 60*a* and 60*b* of the upper punch 6 overlap with each other.

In the present embodiment, at least the radius of curvature of the pressing surface 50*b* of the lower punch 5 and the radius of curvature of the pressing surface 60*b* of the upper punch 6 may be different from each other at a portion where the columnar winding portion 2 is to be formed.

In molding, first, the lower punch 5 is fixed in the die 4 as shown in FIG. 2A, and an inorganic powder 8 as the raw material is supplied to the pressing surfaces 50*a* and 50*b* of the upper surface of the lower punch 5. Then, the upper punch 6 is lowered to press the inorganic powder between the lower punch 5 and the upper punch 6.

The molding pressure at the time of pressure molding is 98 MPa or more, preferably 196 to 490 MPa. Since such a high pressure can be used for pressure molding, the resulting compact has a dense and closely packed surface, in particular, on the surface portion, and as described above, the void occupancy area of the surface layer portion 21 of the columnar winding portion 2 can be smaller than that of the inside 22 of the columnar winding portion 2.

For the same reason, the void distribution at least in the surface layer portion 21 of the columnar winding portion 2 can be made sparse, and the gap C between adjacent voids can be made 6 to 12 μm.

In addition, the compact has a dense and closely packed surface, in particular, on the surface portion, so that the cutting level difference Rδc of the roughness curve of the surface of the columnar winding portion 2 can be 0.2 to 2 μm.

Furthermore, since the surface shape of the molding die (lower punch 5 and upper punch 6 described later) can be faithfully reflected because of pressure molding with high pressure, the radius of curvature of the corner portion 20 where the columnar winding portion 2 and the flange portion 3 intersect may be less than or equal to the diameter of the conductive wire.

Such high pressure can be applied because, as described above, the pressing surfaces 50*a* and 50*b* of the lower punch 5 and the pressing surfaces 60*a* and 60*b* of the upper punch 6 have different radiuses of curvature. On the other hand, when the pressing surfaces 50*a* and 50*b* of the lower punch 5 and the pressing surfaces 60*a* and 60*b* of the upper punch 6 have the same radius of curvature, the compact cannot be taken out of the molding die when pressurized with high pressure. Therefore, since it cannot be pressurized at high pressure but must be pressurized at low pressure, the core component 1 formed by pressure molding has a lot of voids, the strength is inferior, and further, it is easy to generate the particle shedding.

As described above, since the radius of curvature of the arc-shaped pressing surface of the upper punch is different from the radius of curvature of the arc-shaped pressing surface of the lower punch at least at the portion forming the columnar winding portion, it is easy to take out the compact from the molding die as compared with the case where the pressing surfaces of both punches have the same radius of curvature, so that it is possible to perform pressure molding at high pressure. Therefore, the surface layer portion of the columnar winding portion has a small void occupancy area. In addition, since burrs are less likely to be generated in a compact by pressure molding under high pressure, even when polishing is necessary, polishing can be easily performed, and further, the conductive wire to be wound can be less damaged and disconnection or the like can be suppressed.

Figure 3A:
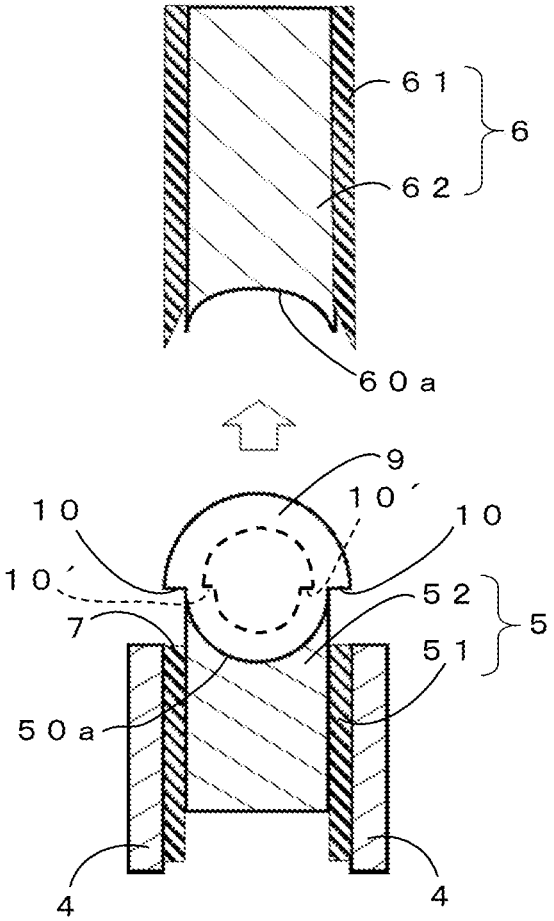
FIG. 3A and FIG. 3B are a cross-sectional view and a longitudinal-sectional view, respectively, showing a state after molding with a molding die.
Figure 3B:
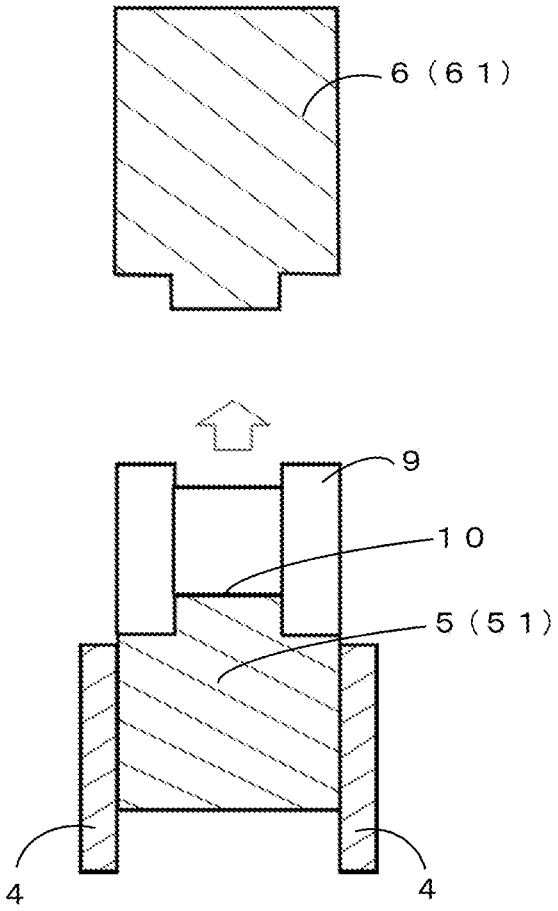

After molding, as shown in FIGS. 3A and 3B, the die 4 is lowered relative to the lower punch 5 and the upper punch 6 so that the stepped portion 7 and the upper end face of the die 4 on the overlapping surface of the lower punch 5 and the upper punch 6 have approximately the same height. Next, the upper punch 6 is moved upward with respect to the lower punch 5. At this time, first, the first upper punch 61 on both sides is raised, and then the second upper punch 62 is raised. This facilitates separation of the upper punch 6 from a compact 9.

The second lower punch 52 is relatively raised with respect to the die 4 simultaneously with or after the rise of the upper punch 6. As a result, the compact 9 can be pushed up, and the compact 9 can be easily taken out.

After removing the raw material powder adhering to the obtained compact 9 by air blow or the like if necessary, for example, the compact 9 is held at the maximum temperature of 1000 to 1200° C. for 2 to 5 hours in an air atmosphere to obtain the sintered body. Further, the sintered body is subjected to polishing such as barrel polishing, if necessary, to obtain the core component 1.

A stepped portion 10 corresponding to the stepped portion 7 due to the difference in the radiuses of curvature of the pressing surfaces 50*a* and 50*b* of the lower punch 5 and the pressing surfaces 60*a* and 60*b* of the upper punch 6 is formed on the surface of the compact 9 corresponding to the columnar winding portion 2 and the flange portion 3. If the stepped portion 10 has a problem in winding the conductive wire around the surface of the columnar winding portion 2, it is preferable to remove as much as possible by polishing.

Figure 4A:
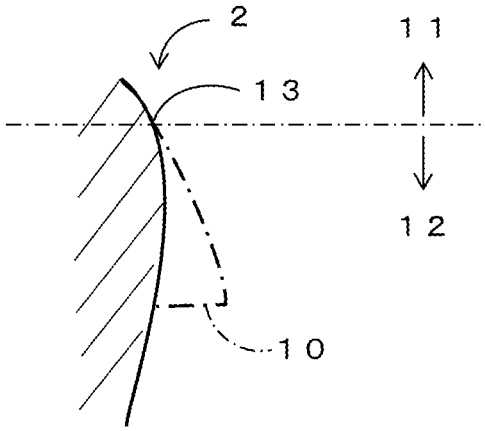
FIG. 4A is a partial enlarged sectional view of the core component.

As shown in FIG. 1B and FIG. 4A, for the core component 1 obtained by polishing, the columnar winding portion 2 has a first region 11 having a curved outer peripheral surface with a large radius of curvature and a second region 12 having a curved outer peripheral surface with a small radius of curvature in a cross section orthogonal to the axial center, and the first region 11 and the second region 12 are connected via a projection 13. At this time, the height of the projection 13 is preferably equal to or smaller than the diameter of the conductive wire wound around the outer peripheral surface of the columnar winding portion 2. As a result, the occurrence of disconnection and offset of the conductive wire can be suppressed.

In addition, the stepped portion 10 may be largely removed by polishing, and the portion may be processed into a planar shape. In this case, as shown in FIG. 4B, in the cross section orthogonal to the axial center, a columnar winding portion 2' has a first region 11' having a curved outer peripheral surface with a large radius of curvature, and a second region 12' consisting of a flat portion 14 whose outer peripheral surface is connected to the first region 11' and a curved surface portion continuous with this with a small radius of curvature, and the first region 11' and the second region 12' are connected via a projection 13'.

The above polishing process may be applied not only to the columnar winding portions 2 and 2' but also to the flange portion 3 in the same manner. That is, as shown in FIG. 1C, in the cross section orthogonal to the axial center, the flange portion 3 has a third region 111 having a curved outer peripheral surface with a large radius of curvature, and a fourth region 112 including a curved surface portion having a curved surface with a small radius of curvature, and the third region 111 and the fourth region 112 are connected via a second projection 131. As a result, it is possible to suppress the occurrence of particle shedding from the second projection 131.

The second projection 131 preferably has a curved outer peripheral surface. Furthermore, the outer peripheral surface of the second projection 131 preferably has a radius of curvature smaller than that of the outer peripheral surface of the flange portion. As a result, the residual stress in the first projection 13 is reduced, so that the first projection 13 is less likely to be brittlely fractured, and the occurrence of particle shedding due to the brittle fracture is reduced.

Figure 4B:
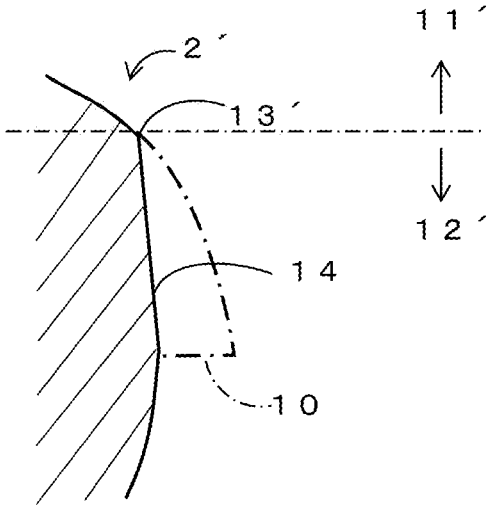
FIG. 4B is a partial enlarged sectional view of another core component.

As in the columnar winding portion 2 shown in FIG. 4B, the fourth region 112 may include the flat portion 14 whose outer peripheral surface is connected to the third region 111 and the curved surface portion continuous with this with a small radius of curvature.

The obtained core component 1 is suitably used as an inductor by winding a conductive wire around the columnar winding portions 2 and 2'. The application of the core component 1 of the present disclosure is not limited to the inductor, and may be applied to the case where members having flanges at both ends and a central portion having a columnar shape and a smooth curved surface shape are formed of ceramics or the like. For example, in the case of manufacturing, with a ceramic, a tape guide for guiding a magnetic tape or the like in which the tape guide has flanges at both ends of a columnar body, the manufacturing can be easily performed by using the core component manufacturing method of the present disclosure.

EXAMPLE

Hereinafter, the core component of the present disclosure will be described in detail by way of Examples and Comparative Example.

Example

The ferrite powder was pressure-molded using a molding apparatus shown in FIGS. 2 and 3 and then sintered at a predetermined temperature to produce a core component.

Comparative Example

A columnar compact of a ferrite powder is obtained by molding the ferrite powder at the same pressure and temperature for the same time as those in Example, and only the central portion of this compact is cut and sintered to produce the core component which has the columnar winding portion made of a sintered body and the flange portion in the both ends thereof.

Measure the Void Occupancy Area

The void occupancy area of the obtained core component was measured by the above-described measurement method. The void occupancy area of each of the surface layer portion and the inside of the columnar winding portion and the flange portion of the core component was measured. The results are shown in Table 1.

TABLE 1

| | | | Void occupancy area (%) |
|---|---|---|---|
| Example | Columnar winding portion | Surface layer portion | 0.842 |
| | | Inside | 1.072 |
| | Flange portion | Surface layer portion | 0.703 |
| | | Inside | 1.235 |
| Comparative Example | Columnar winding portion | Surface layer portion | 3.678 |
| | | Inside | 3.628 |
| | Flange portion | Surface layer portion | 5.144 |
| | | Inside | 5.018 |

It can be seen from Table 1 that, unlike the core component of the Comparative Example, the core component of Example has a void occupancy area in each surface layer portion of the columnar winding portion and the flange portion smaller than that in each of their respective insides, so that it is dense.

What is claimed is:

1. A core component made of a sintered body of an inorganic powder, the core component comprising:

a columnar winding portion having a first axial end and a second axial end;

a flange portion integrally formed with the columnar winding portion at both axial ends of the columnar winding portion, wherein when observed in a cross section perpendicular to an axial direction, a surface layer portion of the columnar winding portion has a void occupancy area smaller than a void occupancy area of an inside of the columnar winding portion, the columnar winding portion has a first region and a second region in a cross section orthogonal to the axial center, the first region having a curved outer peripheral surface with a radius of curvature larger than a radius of curvature of the second region, the second region having a curved outer peripheral surface with a radius of curvature smaller than the radius of curvature of the first region.

2. The core component according to claim 1, wherein the void occupancy area in the surface layer portion of the columnar winding portion is 0.5% to 3%.

3. The core component according to claim 1, wherein when the flange portion is observed in a cross section perpendicular to the axial direction, a surface layer portion of the flange portion has a void occupancy area smaller than a void occupancy area of an inside of the flange portion.

4. The core component according to claim 3, wherein the void occupancy area in the surface layer portion of the flange portion is 0.5% to 4%.

5. A method of manufacturing the core component according to claim 1, the method comprising:

filling and pressure molding an inorganic powder between an upper punch and a lower punch to form a pressure-molded compact, wherein each of the upper punch and lower punch has an arc-shaped pressing surface for forming the columnar winding portion and the flange portion; and sintering the pressure-molded compact to form a sintered body, wherein the arc-shaped pressing surface of the upper punch and the arc-shaped pressing surface of the lower punch have different radiuses of curvature at least at a portion forming the columnar winding portion, and wherein a molding pressure at a time of the pressure molding is 98 MPa or more.

6. The method of manufacturing the core component according to claim 5, further comprising polishing the sintered body.

7. An inductor comprising the core component according to claim 1 and a conductive wire wound around the columnar winding portion of the core component.

8. A core component made of a sintered body of an inorganic powder, the core component comprising:

a columnar winding portion having a first axial end and a second axial end;

a flange portion integrally formed with the columnar winding portion at both axial ends of the columnar winding portion, wherein when observed in a cross section perpendicular to an axial direction, a surface layer portion of the columnar winding portion has a void occupancy area smaller than a void occupancy area of an inside of the columnar winding portion, the columnar winding portion has a first region and a second region in a cross section orthogonal to the axial center, the first region having a curved outer peripheral surface with a radius of curvature larger than a radius of curvature of the second region, the second region having a curved outer peripheral surface with a radius of curvature smaller than the radius of curvature of the first region, wherein the second region includes a flat portion which is continuous with the second region, the flat portion having an outer peripheral surface connected to the first region via a projection.

* * * * *